US010570907B2

(12) United States Patent
Gagne-Marcotte

(10) Patent No.: US 10,570,907 B2
(45) Date of Patent: Feb. 25, 2020

(54) PUSH-PULL COUNTER FLOW HEAT EXCHANGER

(71) Applicant: Gabriel Gagne-Marcotte, Sherbrooke (CA)

(72) Inventor: Gabriel Gagne-Marcotte, Sherbrooke (CA)

(73) Assignee: LES ENTREPRISES DE DEVELOPMENT DURABLE ENERGIE SOLUTONS ET ASSOCIES INC., Sherbrooke (CA)

( * ) Notice: Subject to any disclaimer, the term of this patent is extended or adjusted under 35 U.S.C. 154(b) by 234 days.

(21) Appl. No.: 15/522,643

(22) PCT Filed: Oct. 27, 2015

(86) PCT No.: PCT/CA2015/051098

§ 371 (c)(1),
(2) Date: Apr. 27, 2017

(87) PCT Pub. No.: WO2016/065473

PCT Pub. Date: May 6, 2016

(65) Prior Publication Data

US 2017/0335853 A1 Nov. 23, 2017

Related U.S. Application Data

(60) Provisional application No. 62/069,148, filed on Oct. 27, 2014.

(51) Int. Cl.
*F04D 19/02* (2006.01)
*F28F 3/04* (2006.01)
(Continued)

(52) U.S. Cl.
CPC ..... *F04D 19/022* (2013.01); *F28D 9/0037* (2013.01); *F28F 3/046* (2013.01); *F28F 17/005* (2013.01); *F28D 7/106* (2013.01)

(58) Field of Classification Search
CPC ..... F04D 19/022; F04D 25/08; F28D 7/106; F24F 2007/001; F24F 2007/003;
(Continued)

(56) References Cited

U.S. PATENT DOCUMENTS 1,672,272 A 6/1928 Moore
2,398,113 A * 4/1946 Parrish ..... F04D 19/022 415/178
(Continued)

FOREIGN PATENT DOCUMENTS

CN 2270915 Y 12/1997
DE 2939827 A1 4/1981
(Continued)

OTHER PUBLICATIONS

Extended European Search Report of EP15855288.
(Continued)

*Primary Examiner* — Richard A Edgar
*Assistant Examiner* — Brian O Peters
(74) *Attorney, Agent, or Firm* — Brouillette Legal Inc.; Robert Brouillette

(57) ABSTRACT

A Heat Exchanger Unit comprising a venting unit, a shutter, a counter flow heat exchanger and a plurality of plenums. The venting unit pulls the outside air, or fresh/purer air, from outdoor through the shutter while it pushes the exhausted inside air through the counter flow heat exchanger and the plurality of plenums toward outside air.

31 Claims, 16 Drawing Sheets

(51) Int. Cl.
*F28F 17/00* (2006.01)
*F28D 7/10* (2006.01)
*F28D 9/00* (2006.01)

(58) Field of Classification Search
CPC ..... F24F 2007/005; F24F 2007/007; F24F 7/013; F24F 7/02; F24F 7/025; F24F 7/04; F24F 7/06; F24F 7/08; F24F 12/006; F28F 2250/08
See application file for complete search history.

(56) References Cited

U.S. PATENT DOCUMENTS 2,790,596 A 4/1957 Stirling
3,199,773 A * 8/1965 Stirling ..... F04D 25/166 415/143
3,487,767 A * 1/1970 Svend ..... A01K 1/0058 454/235
6,386,828 B1 * 5/2002 Davis ..... A01K 1/0052 415/147
2002/0166233 A1 * 11/2002 Uchison ..... F28D 9/0025 29/890.039
2008/0113609 A1 * 5/2008 Ehlers ..... D06F 58/20 454/241

FOREIGN PATENT DOCUMENTS

DE 29722529 U1 4/1999
DE 198 35 473 2/2000
DE 10 2005 016 913 10/2006
DE 102010008176 * 2/2010 ..... F28D 7/10
DE 10 2008 058 817 5/2010
EP 2 077 428 7/2009
FR 1 453 297 9/1966
JP S62 791 1/1987
SE 173963 1/1961

OTHER PUBLICATIONS

International Search Report ( ISR ) of (PCT/CA2015/051098).
Written opinion of the International Search Authority of (PCT/CA2015/051098).

* cited by examiner

COUPE A-A

PUSH-PULL COUNTER FLOW HEAT EXCHANGER

CROSS-REFERENCE TO RELATED APPLICATIONS

The present patent application claims the benefits of priority of American Patent Application No. 62/069,148, entitled "Push-Pull counter Flow Concentric Heat Exchanger" and filed at the United States Trademark and Patent Office on Oct. 27, 2015.

FIELD OF THE INVENTION

The present invention relates in the general field of agrifood industry ventilation systems. In particular, the object of the invention is to improve venting capacity of high moisture and contaminated area while reducing energy cost. Precisely, the invention consists of an improved heat exchanger comprising an ingenious combination of 4 modules including a new push-pull axial vane impeller fan.

BACKGROUND OF THE INVENTION

The typical application of a push-pull impeller is well known in HVAC application since 1935 (U.S. Pat. No. 1,672,272) and provide a mean of moving air in opposite direction with a single motor and to concentric cylinder. The anterior art is described in FIG. 1 and generally consists of a dual fan with inverted pitch blades located on the inside (1) and the outside (2) of a flow separation annulus (3).

In agrifood industry, heat, moisture and contaminants such as ammonium must be evacuated from production area to avoid performance lost. This problem is generally solved by high venting flow and high heating costs. Furthermore, most existing heat exchangers can't withstand the dust contaminant or ice formation. Clogging, moisture dripping or absence of good cleaning method compromise the use of heat exchanger in a northern climate.

SUMMARY OF THE INVENTION

The present invention generally addresses the venting problems of agrifood industry by providing a novel heat exchanger assembly. Such heat exchanger assembly comprises an axial vane dual flow impeller in a venting or fan modulus. In some aspect of the invention, the fan assembly is embodied as a counter flow concentric heat exchanger by means of a plenum set. Such an approach aims at providing a safe way to induce heat transfer in the exchanger core, but also aims at providing protection from outside environment since hot air is always surrounding cold air entering the building by the center of the heat exchanger core.

In an aspect of the invention, the heat exchanger aims at providing improved motor cooling and aims at maximizing the recovery of heat loss from a motor located inside a building. In addition, in an aspect of the present invention, an axial fan dual impeller is designed to benefit from two (2) vane stators which induce better flow swirl recovery when compared to prior art or standard design. Such recovery aims at increasing static pressure and at reducing losses due to swirl friction in the exchanger.

Supplementary to these advantages, when configured in a concentric design, the heat exchanger exhibits extra heat exchanges from all the venting units. Such potential benefits are unthinkable in a standard heat exchanger venting apparatus.

In other aspects of the invention, the single stage unit may be easily extended to two or more stages according to the required or needed static pressure.

Accordingly, the present heat exchanger Unit comprises of a low cost dual flow heat exchanger system for installation in any type of building requiring heat and/or air exchanges, such as but not limited to building in the agricultural or food industries where high moisture environment is typically a major concern. Thus, according to one aspect of the present invention, a heat exchanger assembly uses the concentric counter flow heat exchange to allow the mitigation of the moisture through isolation of the incoming cold air. As such the incoming cold air is contained in the inner most conduit isolated by the outer most conduit containing the inside air projected toward the outside of the building through the shutter.

The heat exchanger according to an embodiment having a concentric configuration aims at minimizing energy loss in order to optimize energy consumption. Furthermore, the centrally located motor unit aims at improving cooling of the heat exchanger motor through thermal exchange from the inner conduit incoming outside air surrounding the motor. Moreover, the inner motor unit is further insulated from any noise generated therefrom. As such, having the motor is surrounded by a first inner conduit and second outer conduit thus having the ability of rendering the motor virtually soundless or at least quieter of similar motor deprived of such insulation.

According to yet another aspect of the present invention, the heat exchanger configuration aims at reducing moisture formation compared with conventional systems. The moisture formation is typically reduced on the outside thus minimizing the risk of dripping water in production area. The heat exchanger configuration further aims at reducing the installation time and at reducing the weight of the heat exchange unit. In configurations having in gate and out gate vanes, a greater static pressure performance of the fan is generally observed. In addition, in configurations having both in gate and out gate vanes, an improved swirl recovery aims at generally enhancing overall ventilation performance compared with conventional system. The dual vane unit also works as a supplementary heat exchanger as the vane units isolate cold fluid from peripheral wall, thus aiming at reducing conduction lost and the need of conventional insulation from the fan unit itself. Reduction in the moisture formation on the heat exchanger outside wall and reduced water dripping may also be achieved using the dual impeller fan unit.

According to yet another embodiment, a push-pull counter flow concentric heat exchanger unit allows for vertical wall installation and allow suspended configuration thus aiming at eliminating production area losses. Airfoil shaped vanes having generally optimal angle and spacing as per know aeronautical blade art is permitting wider range of operation from the selected airfoil shape. Therefore, the incorporation of airfoil similar to airplanes blade improves the behavior of the fan unit and heat exchanger unit as a whole. In addition, concentric counter flow air-air heat exchanger aims at improving counter flow efficiency thus aiming at reducing heat losses from outside wall and reduced outside wall moisture in combination with water dripping.

In configurations where the heat exchanger is generally shaped as a long flat shape, air distribution may be substantially improved and may reduce impact on occupied space for producer. Flow vanes also, according to some embodiments, generally allow complete shutdown of the heat exchanger thus aiming at reducing infiltration loss. The presence of the fan unit outside a building further aims at reducing the heat lost or ice formation when heat exchanger is offline.

According to an aspect of the present invention, a heat exchanger assembly having a dual vane configuration is disclosed. The heat exchanger assembly generally comprises an axial fan (or venting) unit, a heat exchanger; and a plenum module having at least a set of plenums, the plenum module operatively interconnecting the axial fan unit and the heat exchanger. The venting unit further comprises a dual flow impeller typically comprising an outer blade row located about the periphery of the dual flow impeller, an inner blade row located about the center axis of the dual flow impeller. The venting unit further comprises an in gate vane located upstream from at least one of the outer and inner blade row, and/or an out gate vane located downstream from at least one of the outer and inner blade row. According to yet another aspect of the present invention, the inner blade row forces outside air, such as cold or fresh air, in the heat exchanger assembly generating a cold air flow and wherein the outer blade row forces inside air out of the heat exchanger assembly generating a hot air flow.

According to yet another aspect of the present invention, the heat exchanger assembly has at least one, some or each of the in gate vane and/or out gate vane that are stator vanes. Furthermore, according to an aspect of the present invention the heat exchanger may be a counter flow heat exchanger. The heat exchanger assembly may comprise a fan unit wherein the in gate vane is a straight or curved vane. The heat exchanger assembly of claim 1, wherein the out gate vane is a curved stator vane.

According to yet another aspect of the present invention, the heat exchanger assembly has a dual flow impelled located between at in gate vanes and out gate vanes.

According to a further aspect of the present invention, the plenums of the heat exchanger assembly are concentric for limiting flow separations and reducing the static pressure loss.

According to yet another aspect of the present invention, the heat exchanger assembly has a concentric counter flow heat exchanger for limiting heat lost and water dripping.

According to yet another aspect of the present invention, the heat exchanger assembly comprises a dual impeller housing and wherein the cold air flow is isolated by the hot air flow.

According to a further aspect of the present invention, the heat exchanger assembly comprises a counter flow heat exchanger having a thermoformed exchanger core. According to yet another aspect of the present invention, the heat exchanger assembly comprises a supplementary splitter and a heating device operatively mounted to the supplementary splitter.

According to yet another aspect of the present invention, the heat exchanger assembly further comprises a shutter system operatively mounted to the axial fan unit.

According to a further aspect of the present invention, the heat exchanger assembly has an inner blade row and an outer blade row with angles of attack to propel air in opposite directions.

According to yet another aspect of the present invention, the heat exchanger assembly comprises a distribution baffle.

According to yet another aspect of the present invention, the heat exchanger assembly comprises a fan unit wherein both the inner blade row and outer blade row have in gate vanes and out gate vanes and wherein the in gate vane of the inner blade row and the out gate vane of the outer blade row form an outside stator and where the outside stator comprises a fixation aperture mounting the shutter system.

According to yet another aspect of the present invention, the heat exchanger assembly comprises a fan unit wherein the inner blade row and outer blade row have in gate vanes and out gate vanes and wherein the in gate vane of the outer blade row and the out gate vane of the inner blade row form an inside stator. According to an aspect of the present invention, the inside stator comprises a rotation clip.

According to yet another aspect of the present invention, the heat exchanger assembly has a concentric heat exchanger comprising a core section and a shell section and wherein the core section may be ice resistant and dimensioned to be larger than half an inch.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel heat exchanger will be described hereinafter. Although the invention is described in terms of specific illustrative embodiments, it is to be understood that the embodiments described herein are by way of example only and that the scope of the invention is not intended to be limited thereby.

The heat exchanger assembly in accordance with the principle of the present invention aims at exchanging heat between exhausted or inside air, typically warm and/or contaminated air, and outside air, typically colder air or cleaner/fresher air. Now referring to FIG. 2, the Heat Exchanger Unit comprises a fan assembly (1), a shutter (2), a counter flow heat exchanger (4) and a plurality of plenums (3). The fan assembly (1) pulls air from outside through the shutter (2) and pushes the inside air through the counter flow heat exchanger (4) and the plurality of plenums (3) toward outside air. One of the functions of the shutter (2) is to stop the outside air from entering the unit while the fan assembly (1) is turned off. The shutter (2) also helps reducing the air contamination when the fan assembly (1) is turned on. One of the plenums (3) functions is to transfer the air from the fan assembly (1) to the counter flow heat exchanger (4) in a way that reduces the energy loss and limits the flow separations. Finally, one of the functions of the counter flow heat exchanger (4) is to transfer the energy from the inside air to the clean outside air. In some embodiment, a concentric configuration aims at reducing the loss of energy inside of the building due to poor insulation since the energy filled exhausted or inside air is surrounding the new air.

Figure 3:
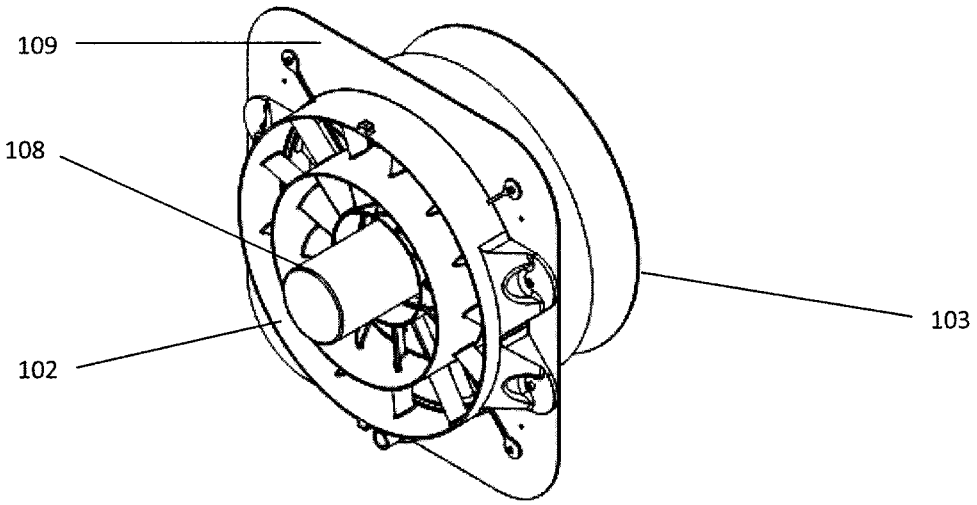
FIG. 3 is a perspective view of a venting unit of a heat exchanger in accordance with the principles of the present invention.
Figure 4:
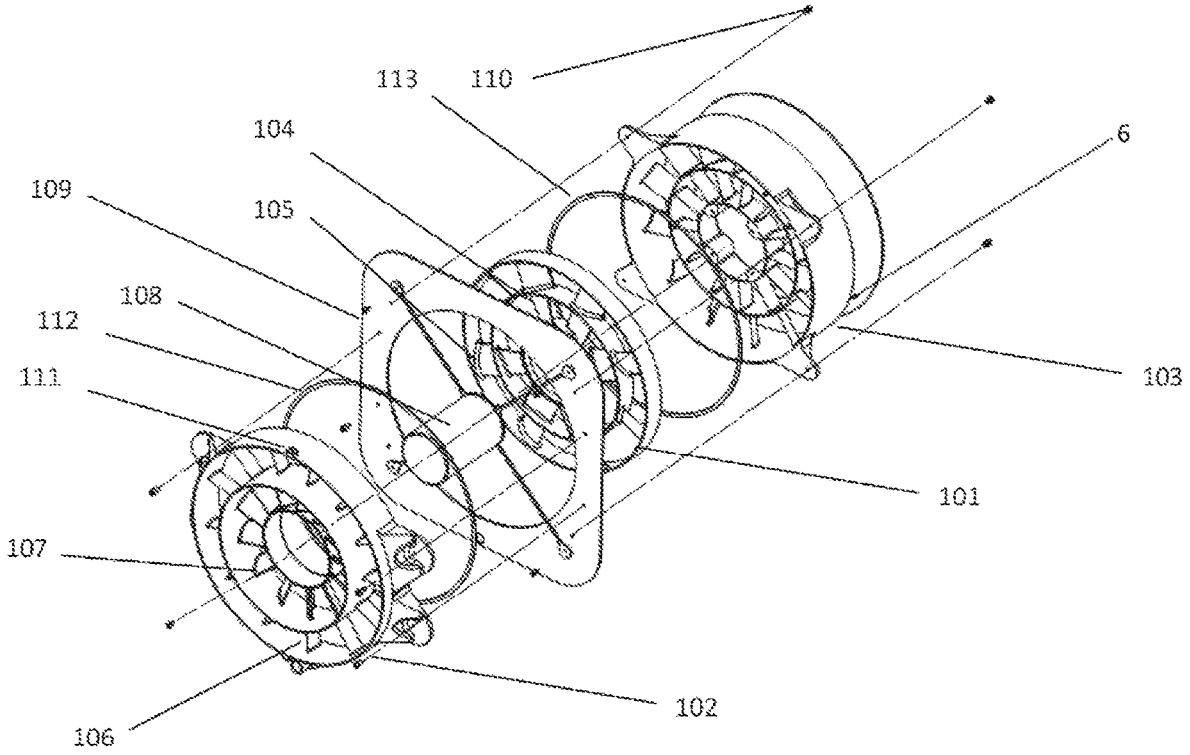
FIG. 4 is an exploded perspective view of a venting unit of a heat exchanger in accordance with the principles of the present invention.
Figure 5:
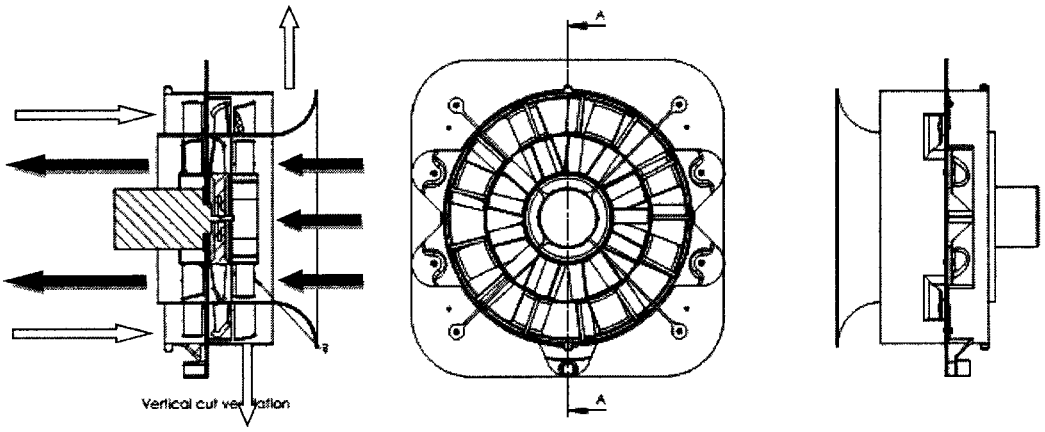
FIG. 5 is a side cut view, front view and side view a venting unit of a heat exchanger in accordance with the principles of the present invention.

Now referring to FIGS. 3 and 4, the dual flow impeller (101) is located between at least two stator vanes (102) and (103). The impeller (101) comprises at least one row of inner blades (104) and outer blades (105). The angles of attack of the blades are such as the air is propelled in opposite direction as indicated by the air flow arrow shown in FIG. 5. The black arrows of FIG. 5 represent outside air or fresh/purer air flowing in the building while the white arrows represent the exhausted or inside air typically evacuated from a building or area. The fan assembly (1) in accordance with the principle of the present invention has the desirable effect of having higher potential increase of air pressure in the air flow and therefore may allow the use of a heat exchanger module.

In some embodiments, a stator vane (102) and/or (103) comprises a straight vane (106) located before or in front of the fan assembly (1) entrance and a curved stator vane (107) located after the fan output according to the air flow direction. The stator vanes (102) and/or (103) may also be configured to allow different pressure increases depending on the application of the heat exchanger unit. Therefore, the entrance portion or output portion stator vane (102) and/or (103) may be straight when use for different applications.

Figure 8:
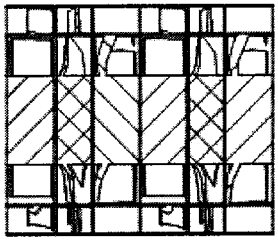
FIG. 8 is a side cut view of the stacking of a plurality of venting units in accordance with the principles of the present invention.
Figure 9:
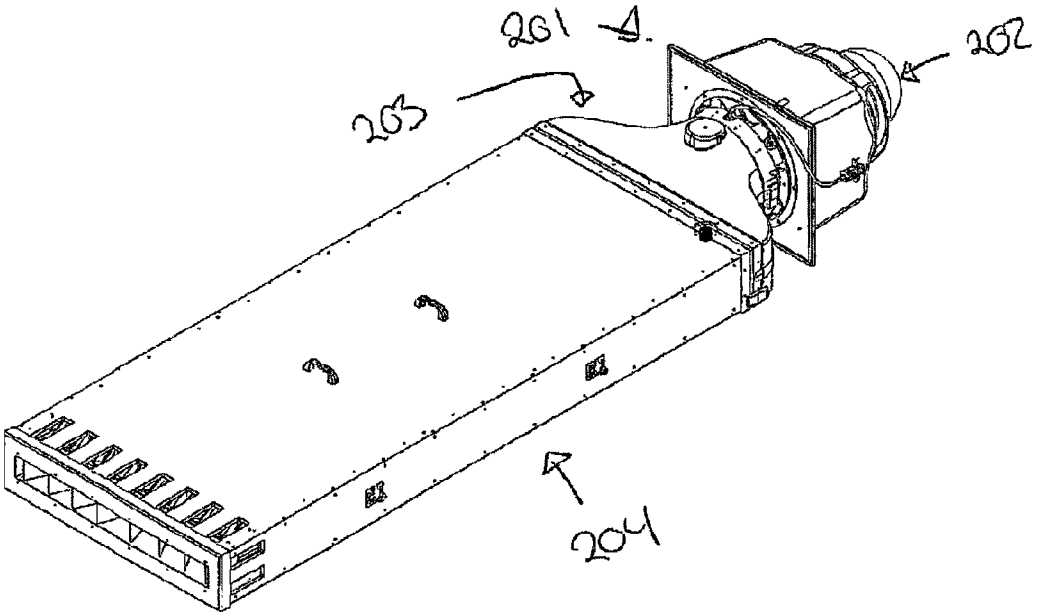
FIG. 9 is a perspective view of a second embodiment of a heat exchanger assembly in accordance with the principles of the present invention.

Now referring to the FIG. 8, a different embodiment of the heat exchanger is shown. One skilled in the art shall understand that such embodiment of the heat exchanger in accordance with the principles of the present invention may be configured to allow different configurations comprising a variable number of push-pull blades and/or stator rows which may increase the total system pressure increase in different applications.

Referring back to FIGS. 3 and 4, the impeller is typically propelled by a motor (108) which is supported by a frame (109) typically configured to mount the different components of the venting module. Such embodiment allows lower costs of assembly while allowing an easy access to the components for maintenance or cleaning purposes.

In a preferred embodiment, the different components of the unit are typically assembled using bolts (110) or any other fastening or securing method. In another embodiment, a hinge incorporated or mounted on plastic stator vanes (102, 103) is used to assemble the unit. Such an assembly typically reduces the assembly cost and increase the life of the unit. Also, an assembly comprising a hinge may also be particularly fit for smaller unit were material resistance is less critical.

Figure 1:
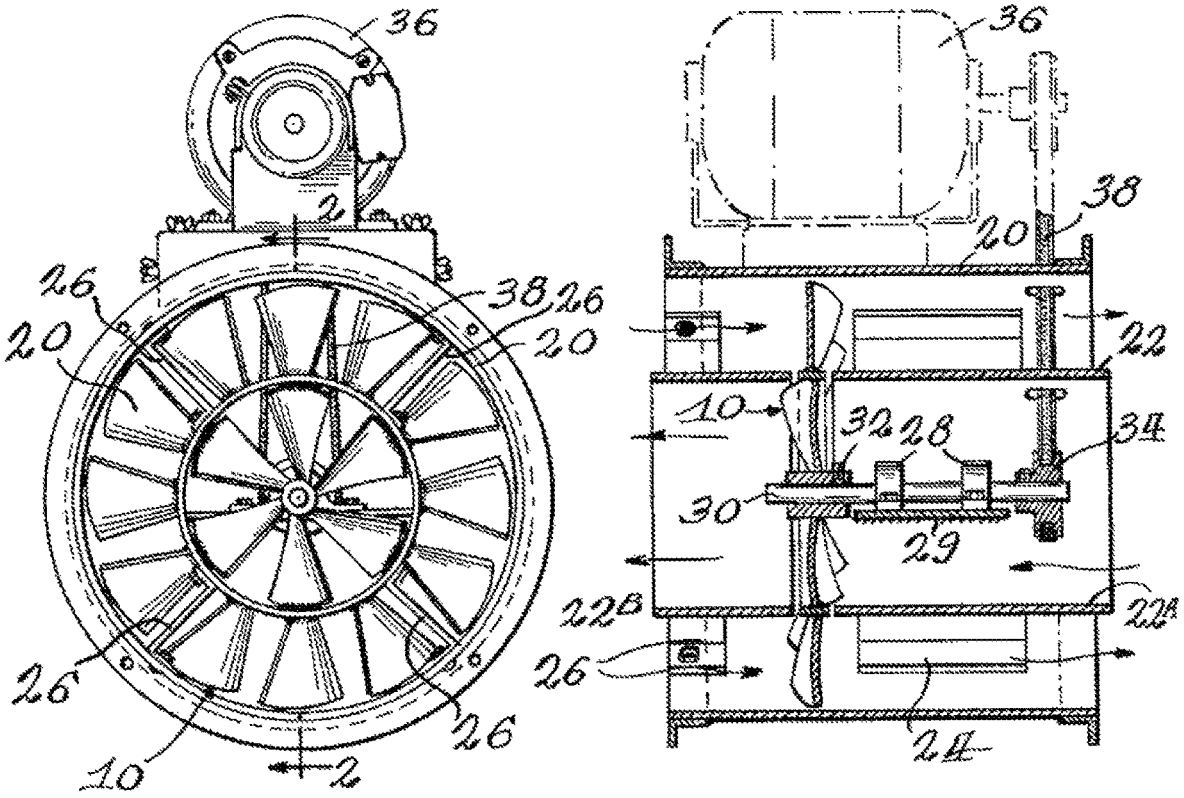
FIG. 1 (PRIOR ART)
FIG. 1 describes one of the prior art inventions of the field of the invention.
Figure 2:
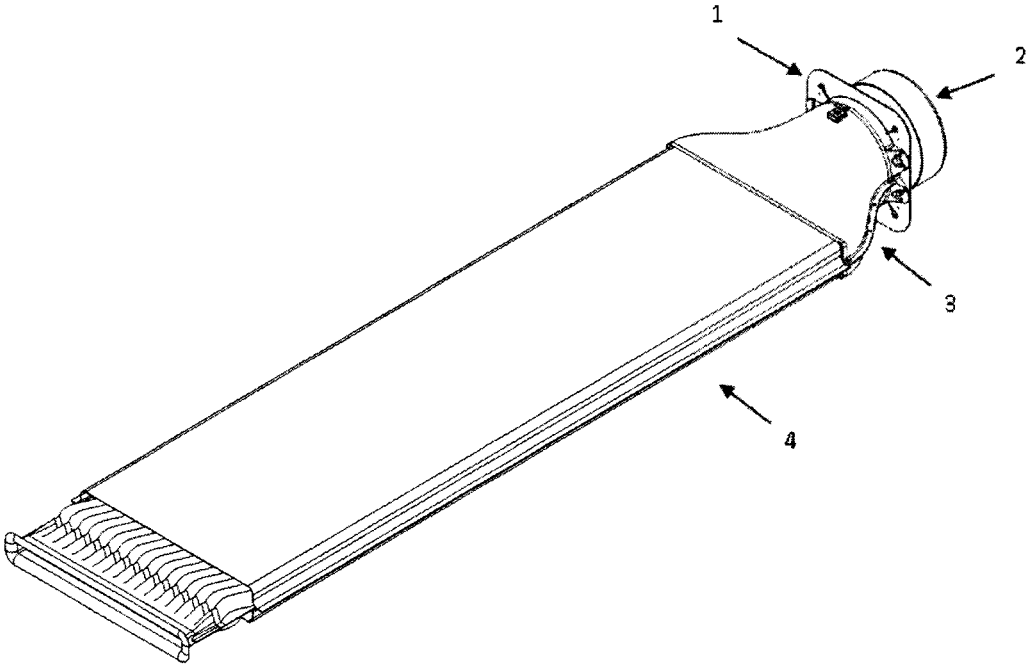
FIG. 2 is a perspective view of a heat exchanger in accordance with the principles of the present invention.
Figure 24:
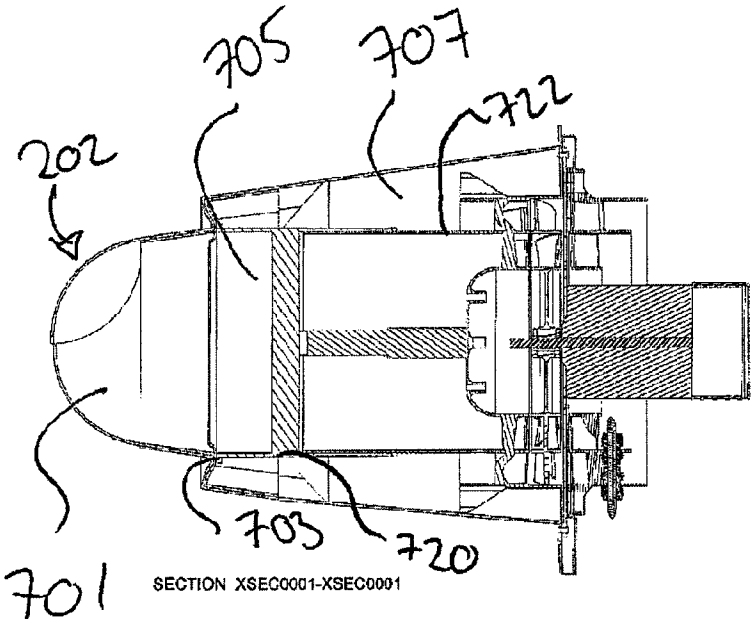
FIG. 24 is a cross sectional view of the venting and shutting units of FIG. 22, the shutting unit being in closed configuration.
Figure 26:
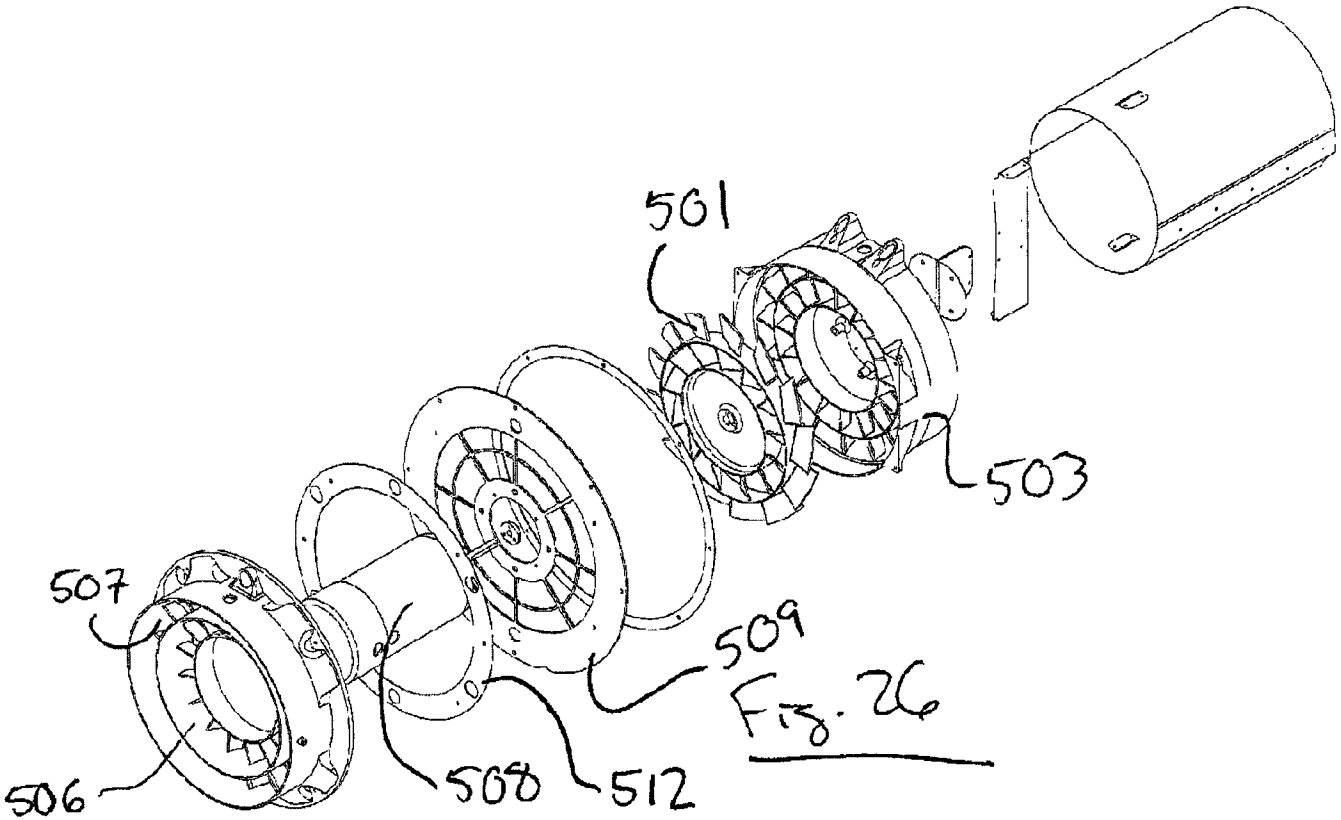
FIG. 26 is an exploded perspective view of the venting and shutting units of FIG. 23.

Referring now to FIG. 24, the plenum module (3) allows the air to circulate between the counter flow heat exchanger (4) and the fan assembly (1) and vice versa. In a preferred embodiment, the inside stator vane (102) may comprise a rotation clip (111). The rotation clip (111) typically reduces the installation or removal duration of the plenum module (3) (as shown in FIG. 2).

Still in a preferred embodiment, the outside stator (103) may comprise fixation aperture configured to allow the installation of a shutter system (2). The second stator may be shaped to create one or more air flow deflectors. Such configuration typically reduces the mix of air flow happening outside of the building or the area. The unit may comprise a plurality of seals (112,113) which are typically located between the stator vanes (102,103) and the frame (109) to further reduce possible water or air leak in the unit.

Figure 6:
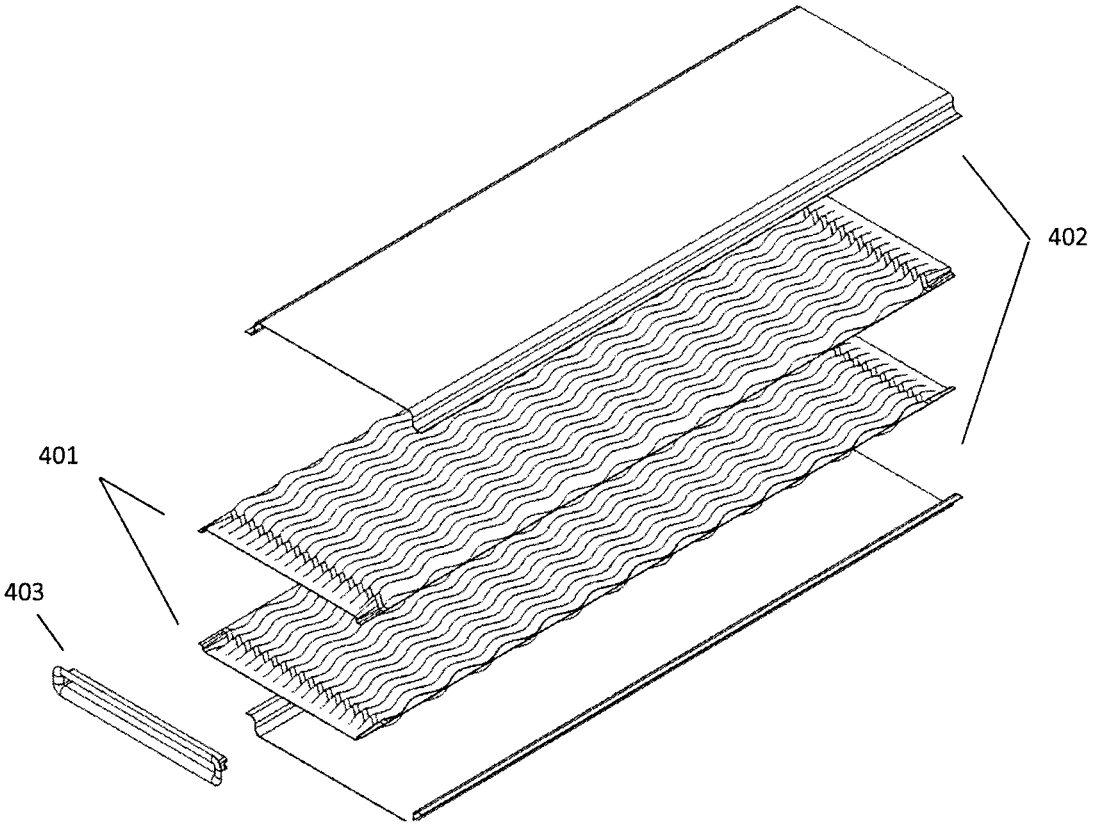
FIG. 6 is an exploded view of a concentric heat exchanger unit in accordance with the principles of the present invention.

Now referring to FIG. 6, a concentric heat exchanger (4) in accordance with the principles of the present invention is shown. The concentric heat exchanger (4) comprises a core section (401) and a shell section (402). The concentric heat exchanger (4) may also include a distribution baffle (403). The core (401) is typically configured to be ice resistant. In order to be ice resistant, of the core is typically dimensioned to be larger than half an inch. The core may also be shaped as irregular winding patterns to increase the exchange of heat.

In a preferred embodiment, the core (401) may be slid outside of the shell (402). Such configuration eases the cleaning and the maintenance of the heat exchanger (4).

During operation of the unit, the outside air circulates inwardly through the core (401) while the exhausted or inside air, typically coming from the inside of a building or of a concealed area, circulates outwardly in the shell (402). One of the shell (402) functions is to isolate the inside of the building from the air inside of the core (401). In other embodiments, the heat exchanger may be thermoformed in order to reduce the costs and to increase the efficiency of the unit.

In embodiments comprising a distribution baffle (403), the distribution of the air flow inside of the building is optimized while the infiltration of the outside air or fresh/purer air in the shell (402) is reduced.

Figure 7:
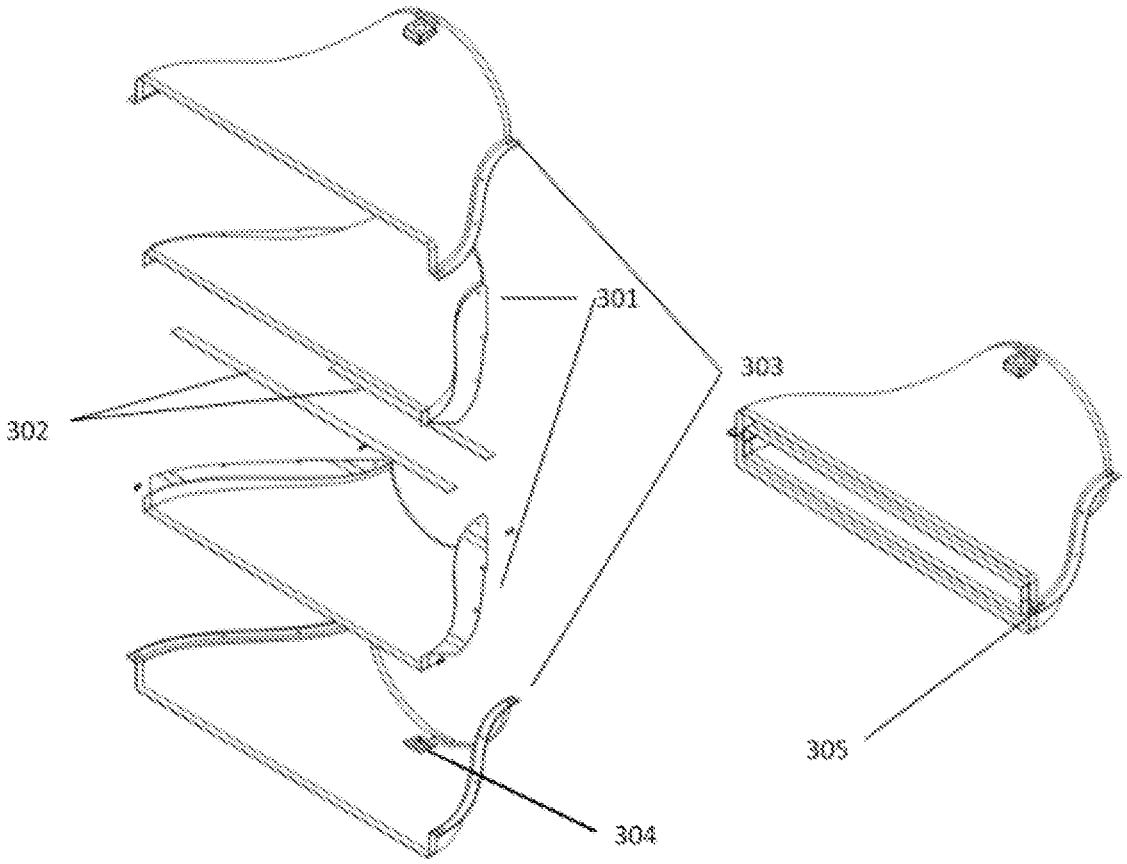
FIG. 7 is an exploded view of a plenum unit in accordance with the principles of the present invention.

Now referring to FIG. 7, the plenums unit (3) in accordance with the principle of the present invention is shown. The plenum unit (3) typically comprise an inside plenum section (301), an outside plenum section (303), one or more support elements (302) and a piping system (304). The inside plenum (301) limits the flow of outside air or fresh/purer air. The outside plenum (303) directs the exhausted or inside air from the counter flow heat exchanger (4) to the fan assembly (1). In another embodiment, the outside plenum (303) may be constructed with two identical parts or with more than two different parts in order to reduce cost and to ease the assembling. The inside plenum (301) shall be of smaller dimension compared to the outside plenum (303) as the inside plenum (301) is installed within the outside plenum (303).

The plenum unit (3) may comprise two identical shells allowing simple assembly and reducing the overall costs. The plenum unit (3) may further comprise supplementary support (302) in order to ease the assembly of the plenum unit (3). Such support (302) is used according to material and thickness selections of the plenum unit (3) components.

The plenum unit (3) may further comprise one or more water elimination mean, such as a hole/aperture and a piping system (304). Such water elimination means allows the elimination of condensation out of the plenum unit (3). The water elimination mean (304) is typically located the top side of the outside plenum (303) and may be used as an aperture for cables or other means to connect electrical component. The plenum units (3) may further comprise quick connect pins (305) allowing a fast connection of the heat exchanger core to the plenum unit (3) for maintenance and cleaning purposes.

According to embodiments, now referring to FIG. 9-13, a heat exchanger assembly in accordance with the principle of the present invention aims at exchanging inside air, typically warm and/or contaminated, and outside air, typically purer and colder. Now referring to FIG. 9, the heat exchanger assembly comprises a venting or axial fan unit (201), a shutter system (202), a heat exchanger (204), preferably a counter flow heat exchanger and at least a set of interior and exterior plenums comprised in a plenum unit (203), preferably a plurality of plenums. The fan unit 201 pulls the outside air or fresh/purer air through the shutter system (202) using a central inner blade fan and pushes the exhausted or inside air through the counter flow heat exchanger (204) using a peripheral outer blade fan and the plurality of plenums contained in the plenum unit (203) toward exterior. Notably, the shutter system (202) is used to stop or at least to limit outside air from entering the unit while the fan unit (201) is turned off. The shutter system (202) also aims at reducing the air contamination when the fan unit (201) is turned on. One of the plenums unit (203) functions is to transfer the air from the venting unit (201) to the counter flow heat exchanger (204) while reducing energy loss and limiting flow separations. Yet, one of the functions of the counter flow heat exchanger (204) is to use the transfer of energy from the inside air to the outside air. In embodiment having a concentric configuration, the loss of energy inside of the building due to poor insulation is further reduced since the energy filled exhausted or inside air is surrounding the outside or fresh outside air.

Figures 10, 11:
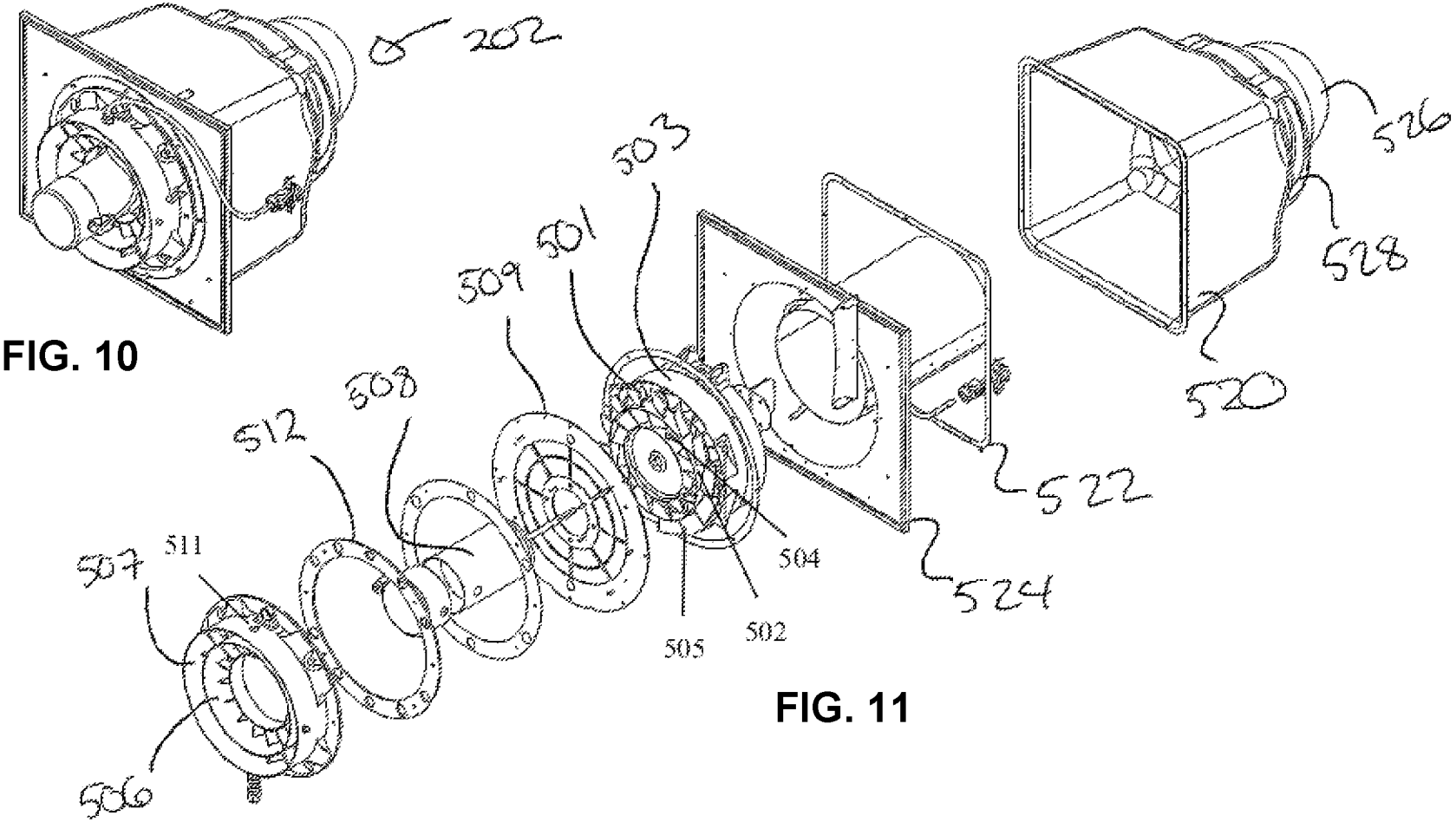
FIG. 10 is a perspective view of the venting unit of the heat exchanger of FIG. 9.
FIG. 11 is an exploded perspective view of the venting unit of the heat exchanger of FIG. 9.

Now referring to FIGS. 10 and 11, the dual flow impeller (501) is located between at least two stator vane parts (502) and (503). The dual flow impeller (501) comprises at least one row of inner blades (504) generally located about the central axis of the fan and a row of outer blades (505) located about the periphery of the fan. The angles of attack of the blades are such as the air is propelled by the airfoil blades of the inner blade row and outer blade row in opposite direction. Outside air flow is preferably directed in the building using the inner blade row while the inside air is generally evacuated from a building or area through the outer blade row. The fan unit (201) in accordance with the principle of the present invention has the desirable effect of having higher potential increase of air pressure in the air flow due to the use of in gate and out gate vanes and therefore allow the use of a heat exchanger module thus increasing the efficiency of the overall heat exchanger assembly. Understandably, though preferred, the heat exchanger assembly may function with at least one of the in gate and/or out gate vane. Likewise, though counter flow heat exchanger is preferred, the heat exchanger unit may comprise known heat exchanger.

In some embodiments, the in gate vanes referred as stator vanes (502) and/or (503) comprises a straight vanes (506) located before or in front of the fan entrance and a curved stator vane (507) located after the fan output according to the air flow direction. The stator vanes (502) and/or (503) may also be configured to allow different pressure increases depending on the application of the heat exchanger unit. Therefore, the entrance portion or output portion stator (502) and/or (503) may be straight or curved depending on its intended use for different applications.

According to the present invention, all elements controlling the airflow of the system, such as in-gate or out-gate vanes, impellers and blades are designed using efficiency principles found in the aeronautical industry, such as plane wings, in order to optimize the airflow before entering the fan unit or the plenum unit. Such optimized airflow ensures low energy consumption of the motor by reducing turbulences of the entering and exiting airflow. Thus, all principles of reduction of turbulences in an airflow found in modern aeronautics may be used to designs the vanes and the impeller to provide improved airflow and are incorporated in the present patent application.

Referring back to FIGS. 10 and 11, the impeller is typically propelled by a motor (508) which is supported by a frame (509) typically configured to mount the different components of the venting module. Such embodiment allows lower costs of assembly while allowing an easy access to the components for maintenance or cleaning purposes.

As described in the previous embodiments, the different components of the unit are typically assembled using bolts (510) or any other fastening or securing method. In another embodiment, a hinge incorporated or mounted on plastic stator parts (502, 503) is used to assemble the unit.

Still referring to FIG. 11, the plenum module (203) allows the air to circulate between the counter flow heat exchanger (204) and the fan unit (201) and vice versa. In a preferred embodiment, the inside stator (502) may comprise a rotation clip (511). The rotation clip (511) typically reduces the installation or removal duration of the plenum module (203) (as shown in FIG. 8). The plenum module (203) may further comprise a water evaporation mechanism (304). The outside plenum section may comprise a top side and the water elimination mechanism may be on the top side of the outside plenum section. In some embodiments, such as the embodiment of FIG. 7, the water evaporation mechanism (304) may be an aperture.

Likewise, in a preferred embodiment, the outside stator (503) may comprise fixation aperture configured to allow the installation of a shutter system (202).

Now referring to FIGS. 10 and 11, the dual flow impeller (501) is located between at least two stator vane parts (502) and (503). The impeller (501) comprises at least one row of inner blades (504) and outer blades (505). The angles of attack of the blades are such as the air is propelled in opposite direction as indicated by the air flow arrow shown in FIG. 5.

Figure 12:
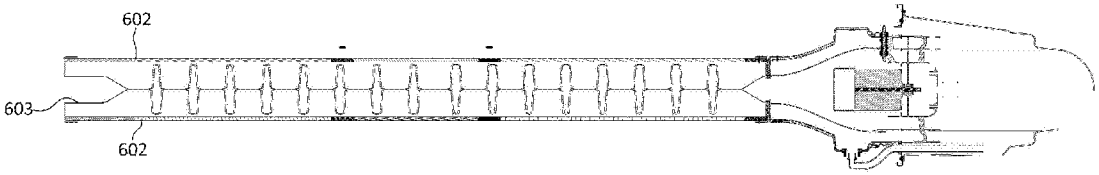
FIG. 12 is a cross sectional view along a plan from a vertical axis and a longitudinal central axis.
Figure 13:
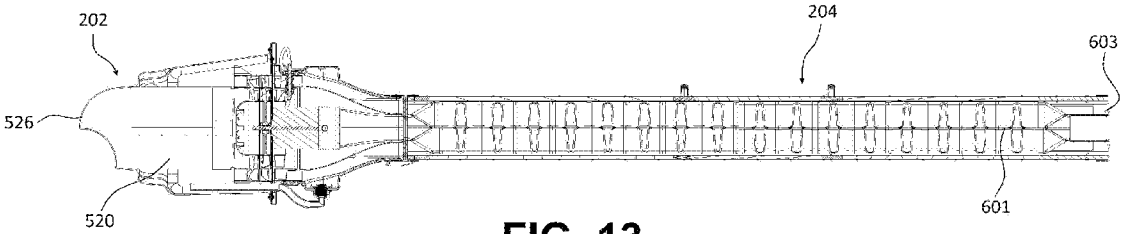
FIG. 13 is a cross sectional view along a plan from a vertical axis and a longitudinal central axis.
Figure 15:
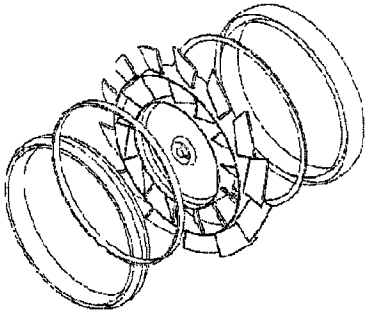
FIG. 15 is an exploded view of the fan of FIG. 14
Figure 14:
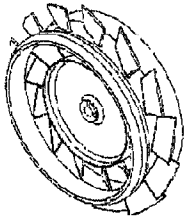
FIG. 14 is a perspective view of an embodiment of a fan having brushed mounted thereto in accordance with the principles of the present invention.
Figure 17:
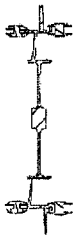
FIG. 17 is a cross sectional view of the fan of FIG. 14.
Figure 16:
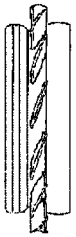
FIG. 16 is a side view of the fan of FIG. 14
Figure 19:
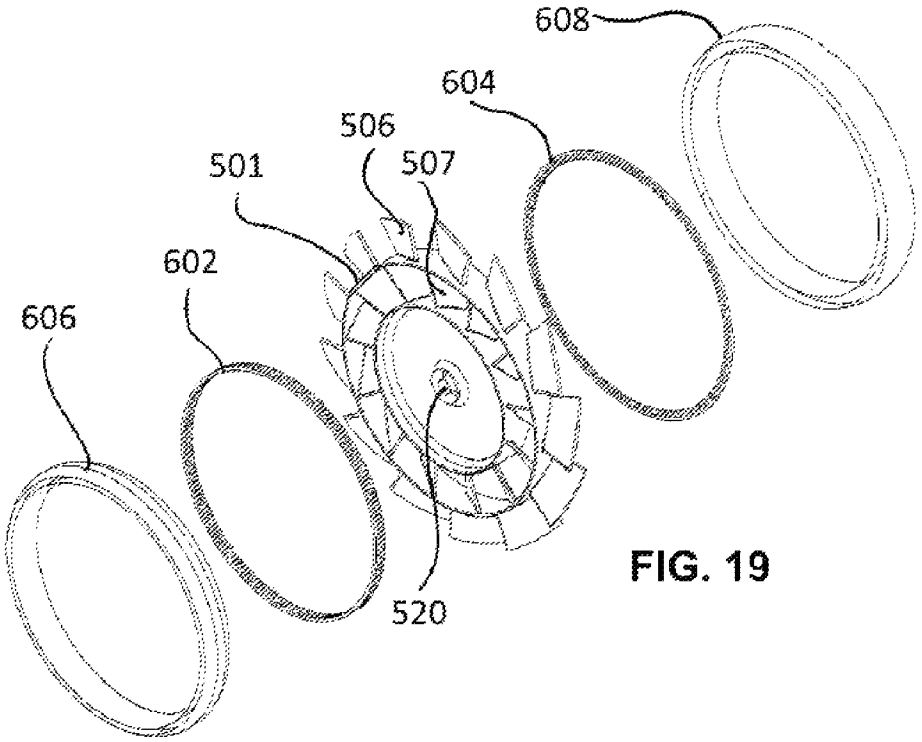
FIG. 19 is an exploded view of the fan of FIG. 18
Figure 18:
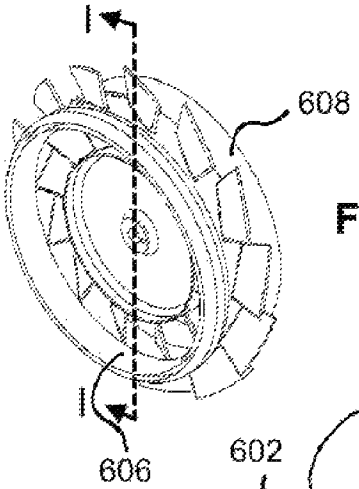
FIG. 18 is a perspective view of an embodiment of a fan having brushed mounted thereto in accordance with the principles of the present invention.
Figure 21:
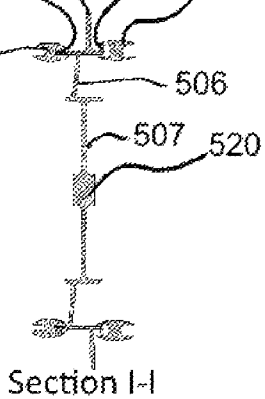
FIG. 21 is a cross sectional view of the fan of FIG. 18.
Figure 20:
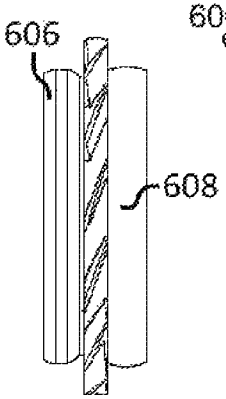
FIG. 20 is a side view of the fan of FIG. 18

Now referring to FIGS. 12-13 a concentric counter flow heat exchanger (204) in accordance with the principles of the present invention is shown. The concentric heat exchanger (204) comprises a core section (601) and a shell section (602). The concentric heat exchanger (204) may also include a distribution baffle (603). The core (601) is typically configured to be resistant to ice. In order to be ice resistant, of the core is typically dimensioned to be larger than half an inch. The core may also be shaped as irregular winding patterns to increase the exchange of heat.

Now referring to FIGS. 14-21, according to an embodiment of the present invention, the heat exchanger assembly further comprises brushes to improve the fan efficiency and mitigate losses or air contamination arising from the air opening at the junction of the inner and outer blade of the axial fan. According to one embodiment, brushes may be vertical 604 or horizontal 602. The brushes may be positioned on the inner side, outer side of the blade or both. Understandably optimal efficiency will be achieved using both outer and inner fan brushes. The brushes 604 and 602 are respectively in contact with annulus 608 and 606 bridging the inner and outer conduits.

Now referring to FIG. 8, according to another embodiment, the geometry of the concentric heat exchange in combination with the dual flow fan allow to synergistically improving efficiency of the heat exchanger assembly allowing better energy efficiency. Additionally, the configuration of the fan unit allows for quick replacement of existing fan units in building without substantial retrofitting. As such, the heat exchanger assembly may replace simple ventilation fan of similar dimension the heat exchanger assembly thus substantially improving the ventilation of the building. For instance, the heat exchanger assembly may replace an existing ventilation unit of a farming building and thus improve the ventilation of the installations.

Figure 22:
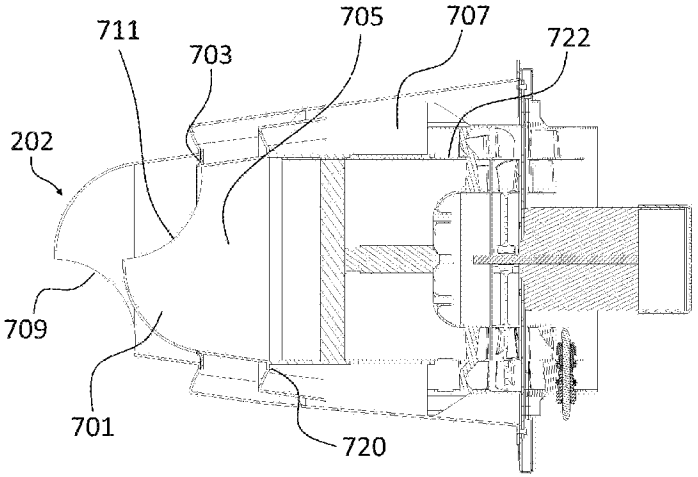
FIG. 22 is a cross sectional view of an embodiment of a venting and shutting units in accordance with the principles of the present invention, the shutting unit being in the open configuration.
Figure 25:
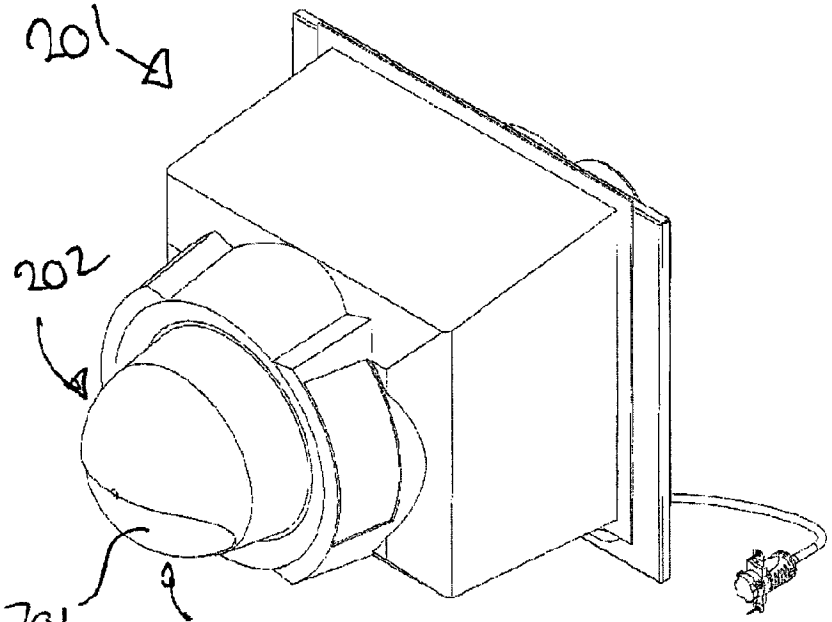
FIG. 25 is a perspective view of the venting and shutting units of FIG. 24.

Now referring to FIG. 22-2, according to yet another embodiment of the present invention, the heat exchanger assembly may comprise a fan unit 201 having an extending unit 720 extending about the inner conduit 705 removably closing the shutting unit flap opening 709. Accordingly, the lateral translation of the shutting conduit extending unit 720 allows closing and opening of the shutter system 202. The lateral translation of the shutting conduit extending unit 720 is generally achieved through a linear actuator thereby expending or retracting the shutting conduit extending unit 720. As such, depending on the level of opening of the shutting conduit extending unit 720, the ventilation of the building may be entirely isolated from the outside allowing only recirculation of the air (the shutting unit in the closed position see FIGS. 24-25). Understandably, other mean of lateral translation known in the art may be used.

Figure 23:
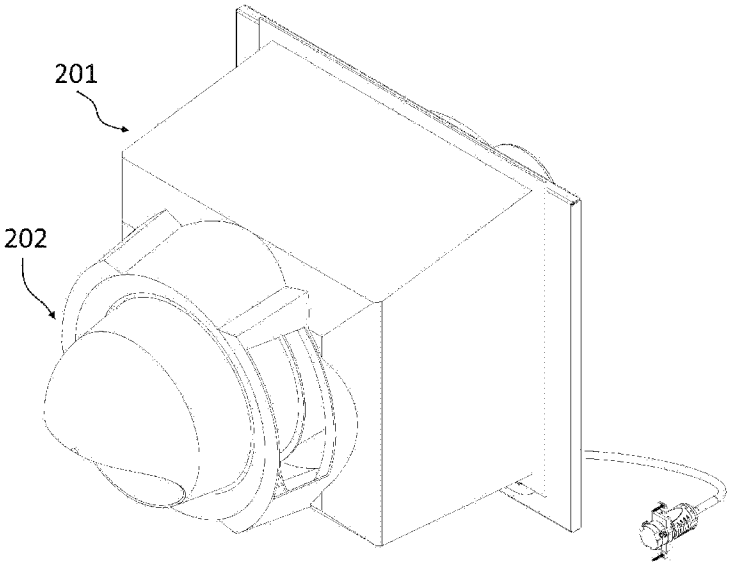
FIG. 23 is a perspective view of the venting and shutting units of FIG. 22.

Likewise, the building may be partially ventilated, allowing some incoming outside air while having a portion of the inside air being recirculated through the shutting unit. Lastly the building may be totally ventilated when the shutter is entirely open (see FIGS. 22-23) in which case no inside air is recirculated in the building. Therefore, in the entirely open configuration (see FIGS. 22-23) the shutting conduit inner conduit 705 is entirely isolated from the outer conduit 707 via sealing member 703. In the open configuration, the extending unit 720 is substantially covering the inner conduit 705 allowing the flap opening 709 to freely allow air inflow through inner conduit opening 711. To the opposite, in the closed configuration, the cover portion 701 of the inner conduit 705 is entirely overlapping shutting unit flap opening 709.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A heat exchanger assembly having a dual vane configuration, the heat exchanger assembly comprising:

a fan assembly comprising a dual flow impeller having a center axis, the dual flow impeller comprising:

an outer blade row about a periphery of the dual flow impeller, the outer blade row being configured to force a first airflow out of the heat exchanger assembly;

an inner blade row about the center axis of the dual flow impeller, the inner blade row being configured to force a second airflow in the heat exchanger assembly;

an in-gate vane, the in-gate vane being upstream from the dual flow impeller;

a counter flow heat exchanger unit comprising a thermoformed exchanger core;

a plenum module, the plenum module comprising at least one set of plenums and the plenum module being operatively interconnecting the fan assembly and the heat exchanger.

2. The heat exchanger assembly of claim 1, the fan assembly further comprising an out-gate vane, the out-gate vane being downstream from the dual flow impeller.

3. The heat exchanger assembly of claim 2, wherein at least one of the in-gate vane or out-gate vane is a stator vane.

4. The heat exchanger assembly of claim 2, wherein the out-gate vane is a curved stator vane.

5. The heat exchanger assembly of claim 2, wherein the dual flow impeller is located between in-gate vanes and out-gate vanes.

6. The heat exchanger assembly of claim 2, wherein both the inner blade row and outer blade row have in gate vanes and out gate vanes and wherein the in gate vane of the inner blade row and the out gate vane of the outer blade row form an outside stator.

7. The heat exchanger assembly of claim 6, the heat exchanger assembly further comprising a shutter operatively mounted to the fan assembly, wherein the outside stator comprises a fixation aperture adapted to mount the shutter.

8. The heat exchanger assembly of claim 2, both the inner blade row and the outer blade row comprising in-gate vanes and out-gate vanes, the in-gate vane of the outer blade row and the out-gate vane of the inner blade row forming an inside stator.

9. The heat exchanger assembly of claim 8, the inside stator comprising a rotation clip.

10. The heat exchanger assembly of claim 1, wherein the in-gate vane is a stator vane.

11. The heat exchanger assembly of claim 1, wherein the in-gate vane is a straight vane.

12. The heat exchanger assembly of claim 1, wherein the set of plenums are concentric to limit flow separations and to reduce the static pressure loss.

13. The heat exchanger assembly of claim 1, wherein the vanes are airfoil shaped.

14. The heat exchanger assembly of claim 1, further comprising a dual impeller housing and being configured for the first airflow to be isolated from the second airflow.

15. The heat exchanger assembly of claim 1, the heat exchanger assembly further comprising a shutter operatively mounted to the fan assembly.

16. The heat exchanger assembly of claim 1, the inner blade row and the outer blade row comprising angles of attack adapted to propel air in opposite directions.

17. The heat exchanger assembly of claim 1, further comprising a distribution baffle.

18. The heat exchanger assembly of claim 1, the heat exchanger unit comprising a core section and a shell section.

19. The heat exchanger assembly of claim 18, the core section being ice resistant, and being dimensioned to be larger than half an inch.

20. The heat exchanger assembly of claim 18, the core section having irregular winding patterns adapted to increase heat exchanges.

21. The heat exchanger assembly of claim 1, the plenum module comprising an inside plenum section, an outside plenum section, one or more support elements and a piping system.

22. The heat exchanger assembly of claim 21, the inside plenum section being adapted to limit airflow.

23. The heat exchanger assembly of claim 21, the outside plenum section being adapted to direct airflow from the heat exchanger unit to the fan assembly.

24. The heat exchanger assembly of claim 21, the inside plenum section having a shape allowing the inside plenum to be inserted in the outside plenum.

25. The heat exchanger assembly of claim 21, the plenum module further comprising a water evaporation mechanism.

26. The heat exchanger assembly of claim 25, the outside plenum section comprising a top side and the water elimination mechanism being on the top side of the outside plenum section.

27. A heat exchanger assembly having a dual vane configuration, the heat exchanger assembly comprising:

- a fan assembly comprising
  - a dual flow impeller having a center axis, the dual flow impeller comprising:
    - an outer blade row about a periphery of the dual flow impeller, the outer blade row being configured to force a first airflow out of the heat exchanger assembly;
    - an inner blade row about the center axis of the dual flow impeller, the inner blade row being configured to force a second airflow in the heat exchanger assembly;
  - an in-gate vane, the in-gate vane being upstream from the dual flow impeller;
- a counter flow heat exchanger unit being concentric for limiting heat lost and water dripping;
- a plenum module, the plenum module comprising at least one set of plenums and the plenum module being operatively interconnecting the fan assembly and the heat exchanger.

28. The heat exchanger assembly of claim 27, the fan assembly further comprising:

- a first vane assembly comprising the out-gate vane being downstream from the outer blade row and comprising the in-gate vane being upstream from the inner blade row;
- a second vane assembly comprising a second out-gate vane being downstream from the inner blade row and comprising a second in-gate vane being upstream from the outer blade row;
- wherein the second in-gate vane and the out-gate vane combination increases static pressure of one of the first or second airflow.

29. The heat exchanger assembly of claim 27, wherein the in-gate vane and the second out-gate vane combination further increases static pressure of one of the second or first airflow.

30. The heat exchanger assembly of claim 27, wherein the in-gate vane of one of the first or second vane assemblies and the out-gate vane of the other vane assembly are curved.

31. The heat exchanger assembly of any one of claims 27, wherein the in-gate vane of one of the first or second vane assemblies and the out-gate vane of the other vane assembly are airfoil shaped.

* * * * *